US007165598B2

(12) United States Patent
DasGupta

(10) Patent No.: US 7,165,598 B2
(45) **Date of Patent: *Jan. 23, 2007**

(54) MAGNESIUM ALLOY AND METHODS FOR MAKING

(75) Inventor: Rathindra DasGupta, Portage, MI (US)

(73) Assignee: SPX Corporation, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/950,491
(22) Filed: Sep. 28, 2004

(65) Prior Publication Data

US 2005/0199363 A1 Sep. 15, 2005

Related U.S. Application Data

(60) Provisional application No. 60/552,708, filed on Mar. 15, 2004.

(51) Int. Cl.
*B22D 17/08* (2006.01)
*B22D 17/12* (2006.01)

(52) U.S. Cl. ..... 164/113; 164/120; 164/312

(58) Field of Classification Search ..... 164/113, 164/120, 312–320
See application file for complete search history.

(56) References Cited

U.S. PATENT DOCUMENTS 5,263,531 A * 11/1993 Drury et al. ..... 164/120
5,879,478 A 3/1999 Loue et al. ..... 148/438
5,911,843 A 6/1999 Bergsma ..... 148/550

FOREIGN PATENT DOCUMENTS

JP 59-189055 * 10/1984

OTHER PUBLICATIONS

English translation of JP '055.*
ASM Handbook, formerly Ninth Edition, Metals Handbook, vol. 15, "Casting" Sep. 1998.

* cited by examiner

*Primary Examiner*—Kuang Y. Lin
(74) *Attorney, Agent, or Firm*—Baker & Hostetler LLP

(57) ABSTRACT

In a method for making a cast product by squeeze casting using an AZ91D alloy, the AZ91D alloy is heated to a liquid state, a shot sleeve is filled with the liquid AZ91D alloy, and a seal is formed between the shot sleeve and a die. In addition, the liquid alloy is injected into the die with an injection unit at a pressure of greater than about 69 Mega Pascal (Mpa) and a gate velocity of less than about 500 millimeters per second (mm/sec) and the AZ91D alloy is solidified in the die to generate the cast product.

9 Claims, 6 Drawing Sheets

MAGNESIUM ALLOY AND METHODS FOR MAKING

CROSS-REFERENCE TO RELATED APPLICATIONS

This application claims priority to provisional U.S. patent application entitled, MAGNESIUM ALLOY AND METHODS FOR MAKING, filed Mar. 15, 2004, having a Ser. No. 60/552,708, the disclosure of which is hereby incorporated by reference in its entirety.

FIELD OF THE INVENTION

The present invention relates generally to casting a magnesium alloy. More particularly, the present invention relates to a method and system for casting AZ91D magnesium alloy.

BACKGROUND OF THE INVENTION

Certain automobile components are typically made with aluminum alloys produced by traditional die cast methods such as high pressure die casting ("HPDC"). HPDC is suitable for the production of thin-walled components. HPDC components may have undesired porosity caused by turbulence and solidification shrinkage, which make these components unsuitable for thick-walled components. HPDC components can also exhibit an undesirable skin effect, whereby the outer layer of the component, or the skin, exhibits relatively less porosity, but the rest of the component exhibits unacceptable levels of porosity, representing degradation in the microstructure of the component beneath the skin. Porosity can have an adverse effect on the ductility or elongation of the component, thus rendering it less suitable for use, especially in automobile components. Currently, thick-walled components may be made with a 380 or 383 aluminum alloy made by HPDC.

SUMMARY OF THE INVENTION

The foregoing needs are met, to a great extent, by the present invention, wherein in some embodiments a light and strong cast product and a system and method for generating the cast product are provided.

An embodiment of the present invention relates to a method for making a cast product by squeeze casting using an AZ91D alloy. In this method, the AZ91D alloy is heated to a liquid state, a shot sleeve is filled with the liquid AZ91D alloy, and a seal is formed between the shot sleeve and a die. In addition, the liquid alloy is injected into the die with an injection unit at a pressure of greater than about 69 Mega Pascal (Mpa) and a gate velocity of less than about 500 millimeters per second (mm/sec) and the AZ91D alloy is solidified in the die to generate the cast product.

Another embodiment of the present invention pertains to a cast product produced by a squeeze casting process with an AZ91D alloy. The cast product includes 8.5% to 9.5% Aluminum, 0.17% to 0.40% Manganese, 0.45% to 0.9% Zinc, 0% to 0.015% Copper, about 0% to 0.05% Silicon, about 0% to 0.001% Nickel, about 0% to 0.004% Iron, about 0% to 0.01% for each of one or more other metals, and Magnesium as the remainder. In addition, a device to generate the cast product includes a gate dimension of about 3 millimeters (mm) to about 10 mm by about 3 mm to about 10 mm and the cast product in an untempered condition includes a yield strength of about 100 Mega Pascal (Mpa) to about 160 Mpa, a tensile strength of about 150 Mpa to about 230 Mpa, and an elongation of about 2%.

Yet another embodiment of the present invention relates to an apparatus to make a cast product by squeeze casting using an AZ91D alloy. The apparatus includes a means for heating the AZ91D alloy to a liquid state, a means for filling a shot sleeve with the liquid AZ91D alloy, and a means for forming a seal between the shot sleeve and a die. In addition, the apparatus includes a means for injecting the liquid alloy into the die at a pressure of greater than about 69 Mega Pascal (Mpa) and a gate velocity of less than about 500 millimeters per second (mm/sec) and a means for solidifying the AZ91D alloy in the die to generate the cast product.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

The present invention provides, in some embodiments, a method for making a cast product by squeeze casting using an AZ91D alloy, the cast product, and a system for making the cast product.

AZ91D is a magnesium alloy that includes: 8.5 to 9.5% aluminum; a minimum of 0.17% manganese; 0.45 to 0.9% zinc; a maximum of 0.015% copper; a maximum of 0.05% silicon; a maximum of 0.001% nickel; a maximum of 0.004% iron; a maximum of 0.01% for each of one or more other metals; and magnesium as the remainder.

Squeeze casting is a term of art used to describe a process of introducing liquid or semi solid alloy into a die and pressurizing the alloy in the die. The relative benefits of squeeze casting over traditional die casting methods include less to no turbulence, less to no air entrapment, reduced shrink porosity, and more rapid solidification. Squeeze casting also offers dimensional control that is comparable to that available with HPDC.

Squeeze casting is suitable for the production of a variety of components. In particular, thick-walled components or components having a thickness of about 2.5 mm or greater benefit from being produced in various squeeze casting devices. Additionally, there is less or no skin effect with squeeze casting as compared to traditional methods of casting, resulting in a component with higher integrity and less porosity. That is, squeeze casting imparts qualities to a metal that are difficult to achieve with conventional die casting, gravity permanent mold, or sand casting, including reduced or no porosity, higher mechanical integrity, improved wear resistance, and the ability to solution treat.

Examples of squeeze casting devices include: horizontal vertical squeeze casting ("HVSC"), vertical casting devices, and the like. HVSC devices are so named because the die clamp opens horizontally and the molten alloy is inserted vertically. In vertical casting devices, the die clamp opens vertically and, generally, the molten alloy is inserted vertically as well. In addition, a great variety of variations and conformation of squeeze casting devices exist. Some such variations are described herein, however, any suitable device for squeeze casting is within the purview of the present invention.

Components produced in a squeeze casting device are subjected to various optional post-casting procedures. These optional procedures include one or more of milling, finishing, chemical and thermal treatments, and the like. In a particular example, the component is subjected to a heat treatment, if desired, to enhance certain properties of the cast components, especially ductility. More particularly, metallurgical properties of products generated by squeeze casting (squeeze casts) are generally enhanced by various heat treatments such as, for example, T6 tempering, T4 tempering, and the like.

Figure 1:
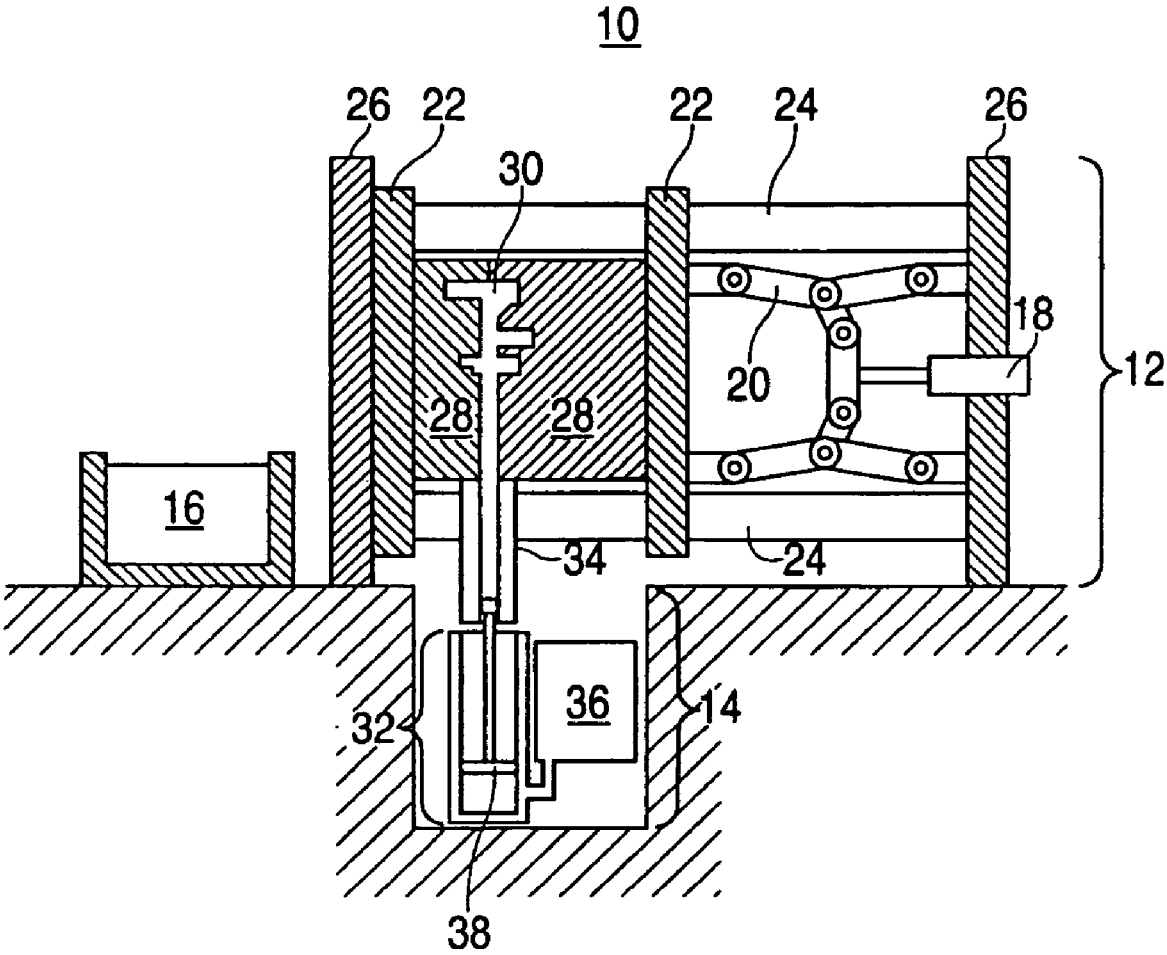
FIG. 1 is a horizontal vertical squeeze casting apparatus suitable for squeeze casting an alloy according to an embodiment of the invention.

FIG. 1 is a horizontal vertical squeeze casting ("HVSC") apparatus for squeeze casting an alloy according to an embodiment of the invention. As shown in FIG. 1, a squeeze casting apparatus 10 includes a die clamp 12, a delivery system 14, and a holding furnace 16.

The die clamp 12 includes an actuator 18, clamping knuckles 20, platens 22, tie bars 24, end plates 26, and die 28. The actuator 18 is configured to exert a force upon the clamping knuckles 20 and thereby engage and separate the die 28. In this regard, the die 28 includes a mated pair of subunits configured to engage one another to form a die cavity 30. As described herein, it is the die cavity 30, into which, liquid alloy is introduced to generate a cast product. To continue, the platens 22 are configured to facilitate distributing the force exerted by the actuator 18. The tie bars 24 are fixedly attached to the end plates 26 and configured to provide structural integrity to the die clamp 12. The tie bars 24 also provide a guide, upon which the platens 22 ride and thereby facilitate proper alignment of the die 28.

The deliver system 14 includes an injection unit 32, and a sleeve 34. The injection unit 32 includes any suitable actuator or other such device operable to generate sufficient force so as to inject the liquid or semi-liquid alloy into the die cavity 30 at the desired pressure. In addition, the injection unit 32 is configured to inject the alloy at a specified rate or gate velocity. In a particular example, the injection unit 32 includes a hydraulic system 36 configured to drive a pneumatic ram 38. As shown in FIG. 1, the pneumatic ram 38 is functionally attached to the sleeve 34 so as to force alloy from the sleeve 34 into the die cavity 30. In this regard, the sleeve is configured to mate with the die 28 and form a substantially liquid-tight seal with the die 28. In addition, the sleeve 34 optionally includes various heating, cooling, and sensing devices.

The holding furnace 16 is configured to maintain a body of liquid metal alloy at a predetermined temperature. The holding furnace 16 is optionally configured to heat the metal alloy to the liquid state.

Figure 2:
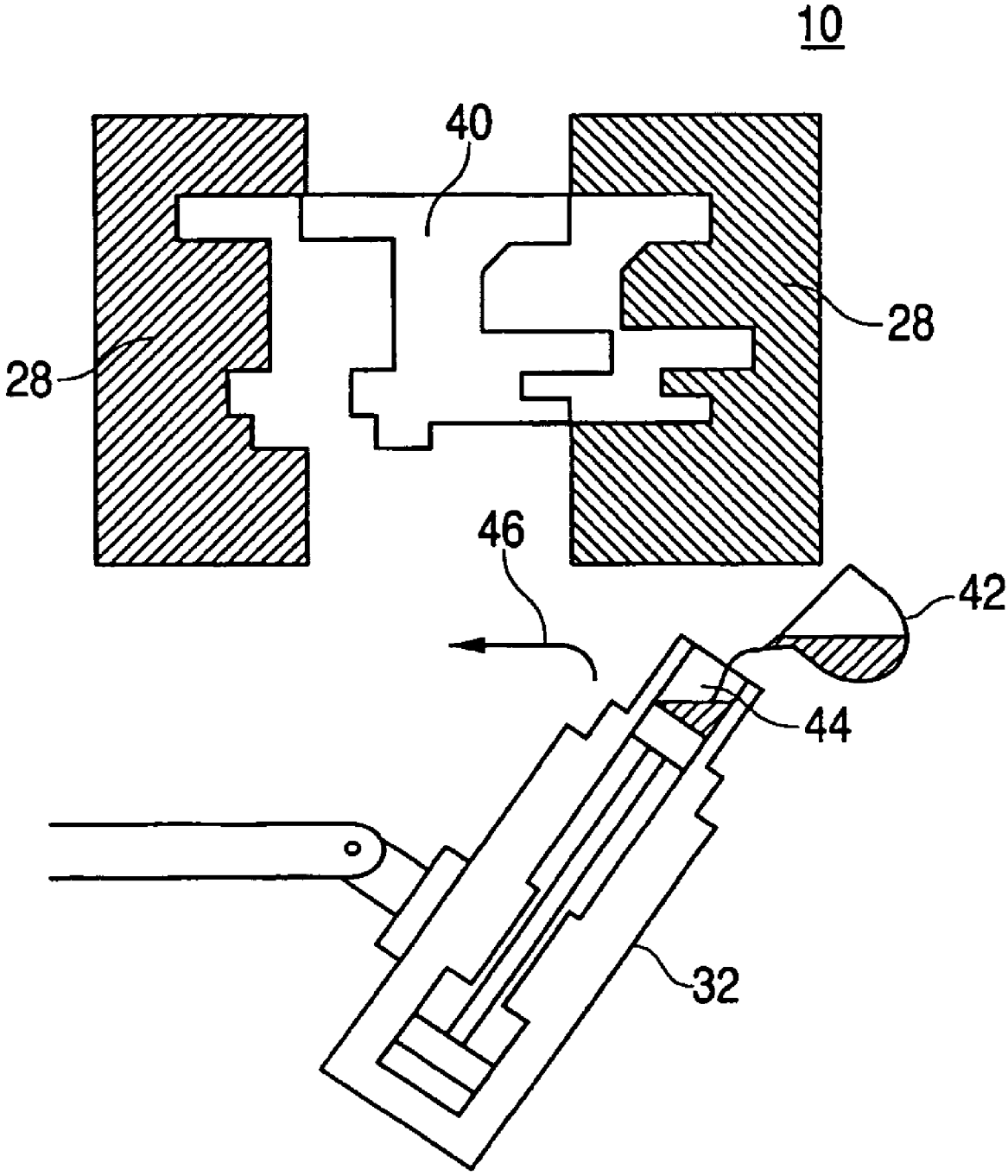
FIG. 2 is a detailed view of the apparatus of FIG. 1 for squeeze casting an alloy according to an embodiment of the invention.

FIG. 2 is a simplified cutaway view of the squeeze casting apparatus 10 according to another embodiment. The squeeze casting apparatus 10 of FIG. 2 is similar to the squeeze casting apparatus 10 of FIG. 1 and thus, for the sake of brevity, those elements described in FIG. 1 will not be described again. As shown in FIG. 2, the die 28 is separated to remove a cast product 40. The cast product 40 generally corresponds to the die cavity 30. The cast product 40, according to embodiments of the present invention, is lighter and at least as strong as conventional cast products. In this regard, the cast product 40 includes AZ91D alloy which, by virtue of its magnesium content, is lighter than aluminum alloys conventionally employed. In addition, the cast product 40, by virtue of the squeeze casting, has a higher integrity as compared to conventionally cast products. Therefore, cast products generated according to embodiments of the invention are suitable to replace a variety of conventionally cast products. In particular, thick walled aluminum cast products, i.e., products with a wall thickness of 10 mm to 14 mm, are readily replaced. Specific examples of thick walled aluminum cast products that are readily replaced by squeeze cast magnesium alloy AZ91D include: axle carriers; front covers; rear axle covers; engine mounts; and the like.

Also shown in FIG. 2, the injection unit 32 is a tilt-docking variety depicted in a filling orientation. That is, the injection unit 32 is tilted so that liquid alloy may be poured from a transfer vessel 42 into a shot sleeve 44 in a manner so as to reduce turbulence. In this regard, reducing turbulence generally reduces porosity of the cast product 40. As indicated by the arrow 46, the injection unit 32 is tilted upright in preparation to inject the die cavity 30 with the alloy. The squeeze casting apparatus 10 shown in FIGS. 1 and 2 illustrates an HVSC apparatus. However, in another embodiment, the squeeze casting apparatus may also be one where the die 28 opens vertically.

Figure 3:
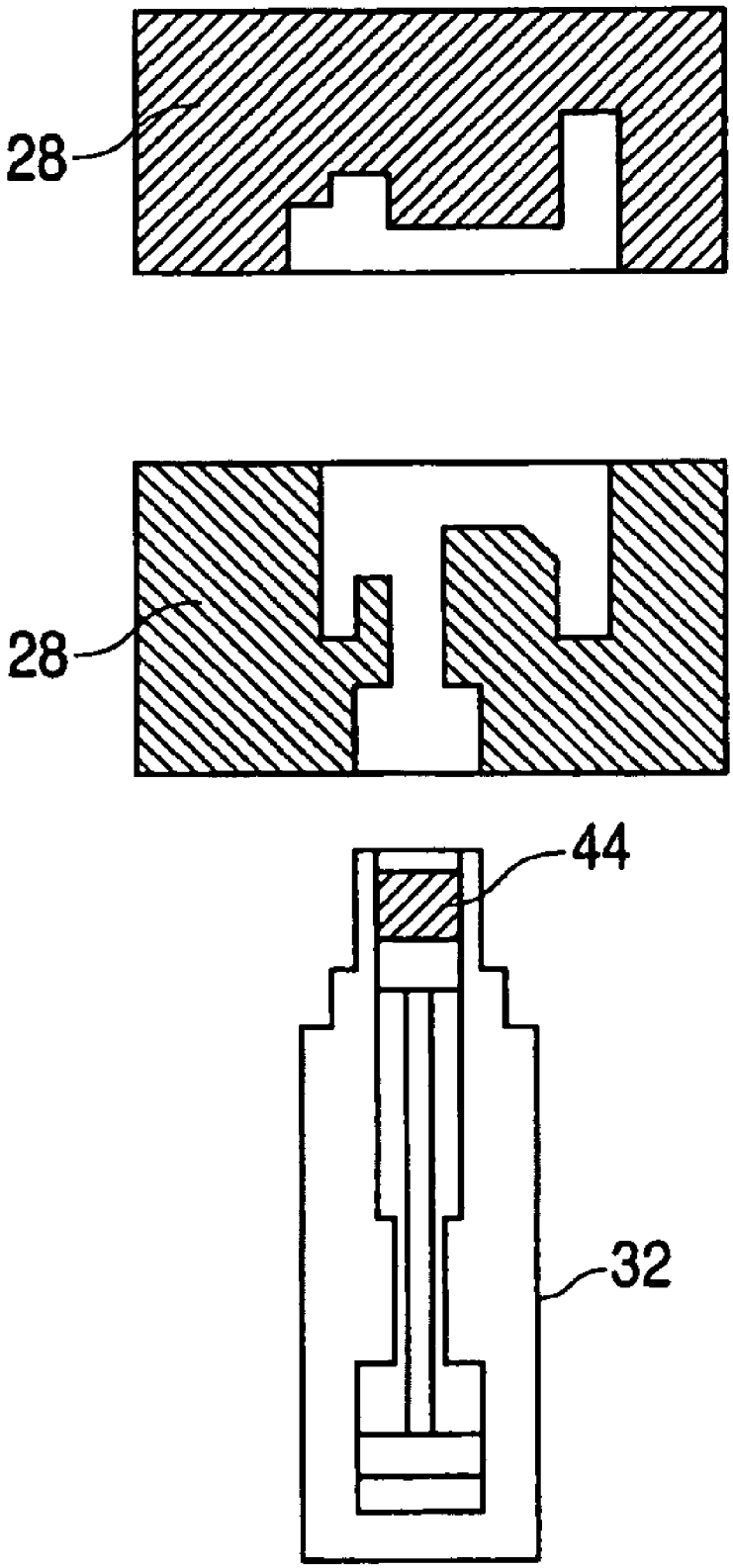
FIG. 3 is a vertical squeeze casting apparatus suitable for squeeze casting an alloy according to an embodiment of the invention.

FIG. 3 is a simplified cutaway view of the squeeze casting apparatus 10 according to another embodiment. The squeeze casting apparatus 10 of FIG. 3 is similar to the squeeze casting apparatus 10 of FIGS. 1 and 2 and thus, for the sake of brevity, those elements described in FIGS. 1 and 2 will not be described again. As shown in FIG. 3, the die 28 operates in a vertical manner and is therefore broadly classified as a vertical squeeze casting apparatus. Particular examples of vertical squeeze casting devices suitable for use in various embodiments of the invention include at least those produced by THT Presses, Inc. of Dayton, Ohio 45414, U.S.A.

Figure 4:
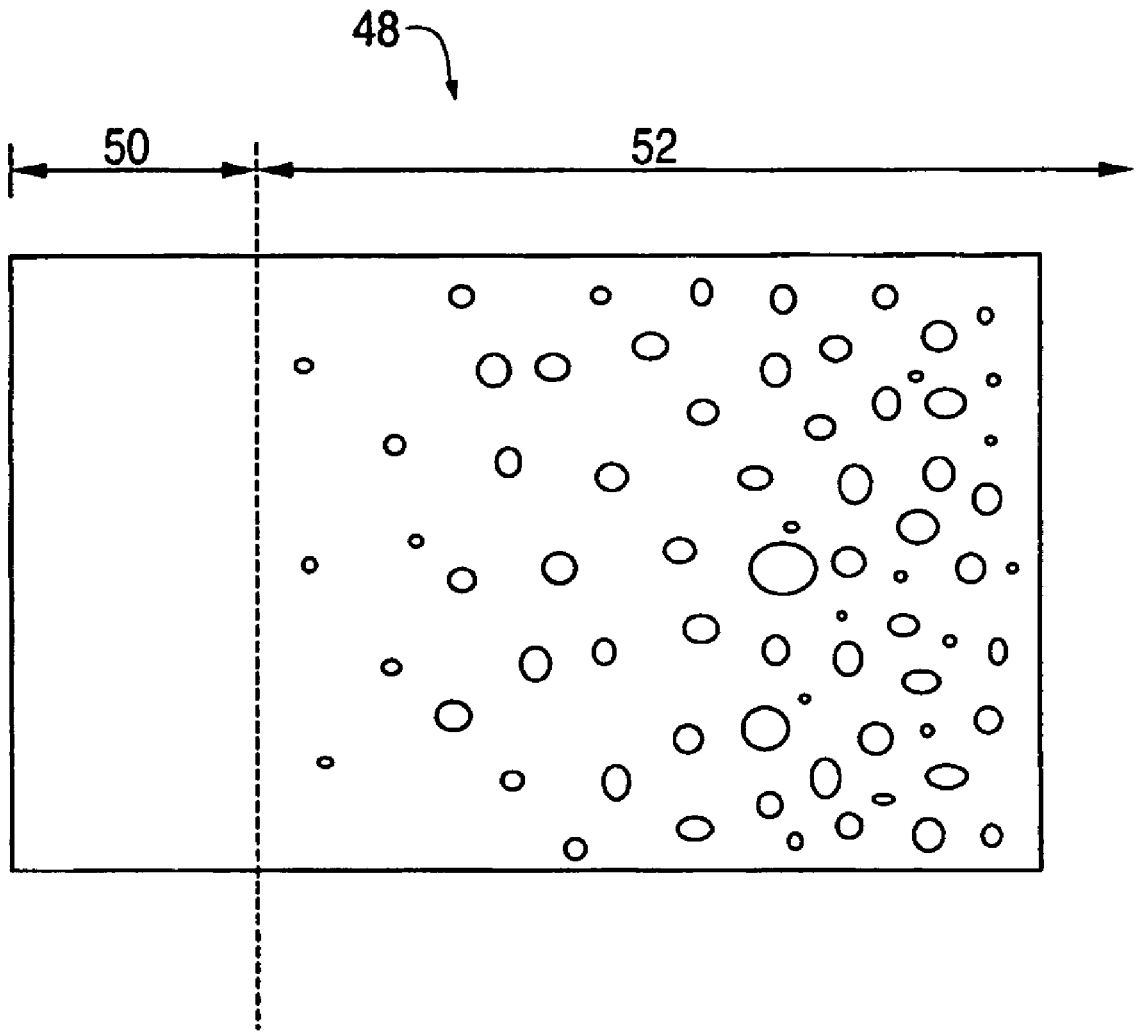
FIG. 4 is a photograph showing an alloy made by traditional high pressure die casting.

FIG. 4 is an illustration of a section in a cast product 48 made by the traditional HPDC process showing the skin effect. As shown in FIG. 4, a skin 50 of the cast product 48 has relatively fewer voids in comparison with a body 52 of the cast product 48. This skin effect is generally responsible for a reduction in mechanical properties of the conventionally cast product 48 and is particularly worrisome when further machining is preformed upon the cast product 48. In this regard, during machining of the cast product 48, the skin 50 may be removed and the relatively porous, and thus weaker, body 52 is exposed.

Figure 5:
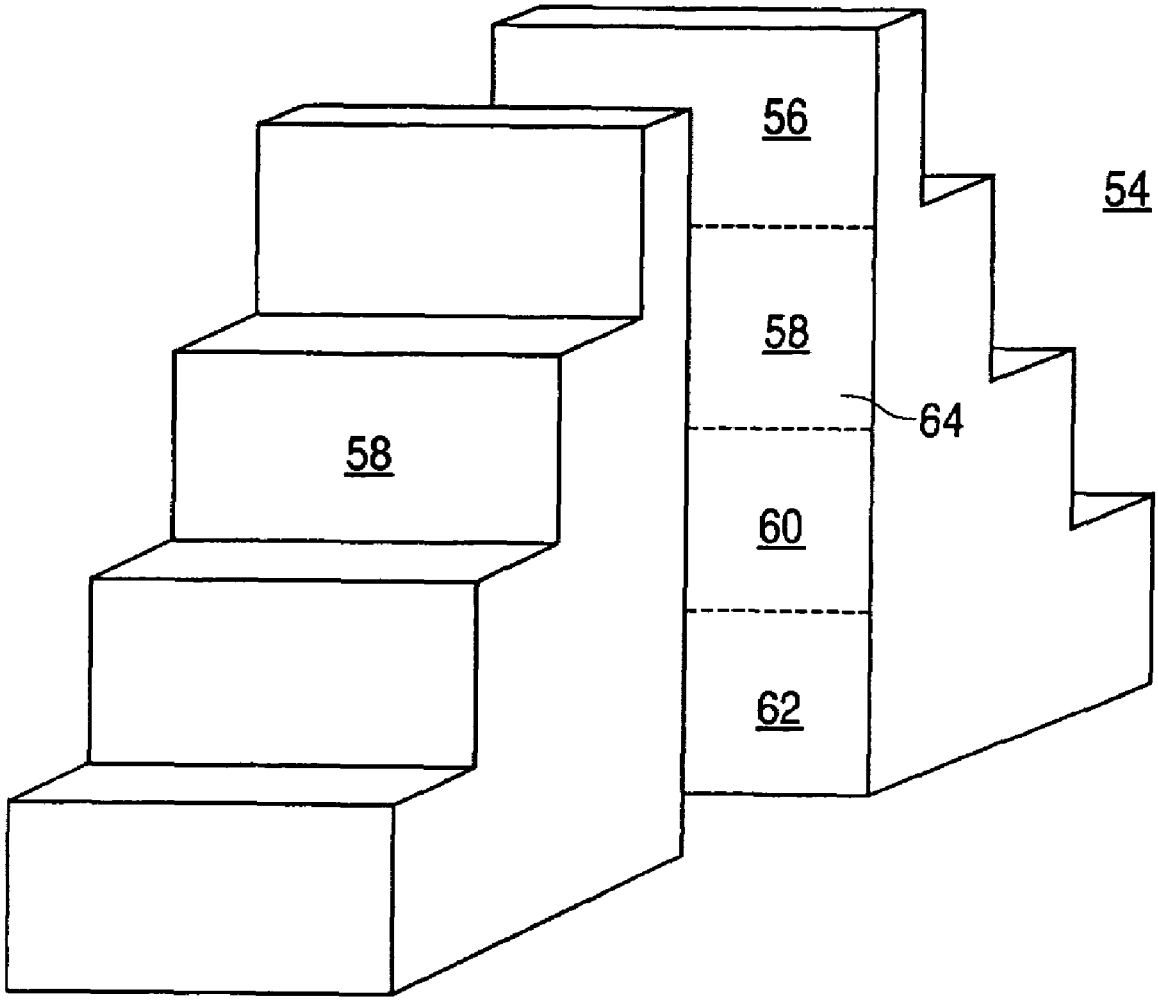
FIG. 5 is a photograph showing a cast product produced in accordance with an embodiment of the invention.

FIG. 5 is a perspective view of a cast product 54 produced in accordance with an embodiment of the invention. As shown in FIG. 5, the cast product 54 is a step block that includes steps 56–62. The steps 56–62 vary thicknesses. In a particular example, the thickness of the steps 56–62 are 2, 6, 10, and 14 mm respectively. In addition, the cast product 54 has been bisected to reveal an interior surface 64. Examination of the interior surface 64 is performed in order to ascertain the metallurgical properties of the alloy at the steps 56–62. According to an embodiment, cast products produced via the method described herein exhibit lower porosity and improved metallurgical properties over conventionally cast products.

The cast product 54 may be evaluated in an "as is" state or otherwise untempered state or a heat treatment may be applied. Examples of heat treatments include a T4 or T6 temper.

In addition to the thickness and temper, a variety of other parameters may be varied, such as, for example, injection pressure, gate velocity, alloy temperature, and the like. According to an embodiment, the injection pressure utilized to generate the cast product is 69 Mega Pascals ("Mpa") or greater. More particularly, the injection pressure is 70 to 100 Mpa. In addition, the gate velocity, according to an embodiment, 500 mm per second ("mm/sec") or less.

Surprisingly, with the present inventive method of casting, wall-thickness does not significantly influence tensile properties. That is, thick-walled components made via squeeze casting have surprisingly favorable tensile properties that are not inferior to the properties of thin-walled components, as occurs in alloys made with HPDC.

Squeeze casting, according to the method disclosed herein, renders components with higher ductility, higher tensile properties, and higher wear resistance. These improved properties are at least in part a factor of the reduced porosity and refined microstructure of components made by squeeze casting.

Automobile components that may be manufactured by the present inventive method include cross members, control arms, steering knuckles, pistons, engine mounts, scroll compressors, wheels, axle carriers, axle covers, valve housings, steering column housings, and crankshaft hubs.

Examples of tensile properties of the cast product 54 generated by the present inventive method are as follows:

TABLE 1

| Location and Thickness | Gage Dimensions | Yield Strength (Mpa) | Tensile Strength (Mpa) | Elongation (%) |
|---|---|---|---|---|
| Step 62 (14 mm) | 6.35 mm × 6.07 mm | 115 | 168 | 2.0 |
| Step 60 (10 mm) | 6.35 mm × 6.07 mm | 117 | 178 | 2.0 |
| Step 58 (6 mm) | 6.35 mm × 6.07 mm | 118 | 171 | 2.0 |

The results presented in Table 1 are unexpected in light of published data on squeeze cast alloys. Expected yield strength is 104+/−4 Mpa. The above results are also unexpected in light of published NRC data. With NRC, expected yield strength is 105+/−6 Mpa. Also surprising is that wall-thickness has no significant effect on mechanical properties.

Examples of tensile properties of the cast product 54 generated by the present inventive method including a T6 temper heat treatment are as follows:

TABLE 2

| Location and Thickness | Gage Dimensions | Yield Strength (Mpa) | Tensile Strength (Mpa) | Elongation (%) |
|---|---|---|---|---|
| Step 62 (14 mm) | 6.4 mm × 5.97 mm | 135 | 210 | 2.0 |
| Step 60 (10 mm) | 6.4 mm × 5.97 mm | 140 | 199 | 2.0 |
| Step 58 (6 mm) | 6.4 mm × 5.97 mm | 139 | 196 | 2.0 |

The results presented in Table 2 are unexpected in light of published data on AZ91 with a T6 temper. Expected yield strength of AZ91 made by sand casting with a T6 is 118+/−2.8 Mpa. Also surprising is that wall-thickness has no significant effect on mechanical properties.

The present inventive method produces an AZ91D magnesium alloy with surprising properties as demonstrated in the following table:

TABLE 3

| Alloy - Temper | Process | Yield strength (Mpa) | Tensile Strength (Mpa) | Elongation (%) |
|---|---|---|---|---|
| 380-F | HPDC | 130–155 | 172–185 | 1.2–1.4 |
| 380-F | Squeeze cast | 138–159 | 227–245 | 2–3 |
| 380-F | SSM (SLC ™) | 131–152 | 241–255 | 2–4 |
| 383-F | HPDC | 145 (avg) | 200 (avg) | 1.25 (avg) |
| AZ91D-F | Squeeze cast | 115–118 | 168–178 | 2.0 (avg) |
| AZ91D-T6 | Squeeze cast | 135–140 | 196–210 | 2.0 (avg) |
| AZ91D-T4 | Squeeze cast | 92–101 | 228 to 247 | 7.0–11.0 |

SLC™ in the Table 3 refers to sub-liquidus casting, a form of semi-solid casting whereby a slurry is formed in the shot sleeve. The trademark is owned by THT of Dayton, Ohio.

As exhibited by the data in the Table 3, AZ91D with a T6 temper produced by the present inventive squeeze cast method provides unexpected yield strength and tensile strength as compared AS91D-F (that is, with no heat treatment; the component is in its "as-cast" condition). Additionally, AZ91D with a T6 temper produced by the present inventive squeeze cast method provides yield strength, tensile strength, and elongation comparable to 380 and 383 aluminum alloys typically used to make thick-walled components but with improved integrity evidenced by decreased porosity achieved with squeeze casting.

Also exhibited by the data in the Table 3, squeeze cast AZ91D magnesium alloy with a T4 temper far exceeds the tensile strength and ductility of 380 HPDC. In addition, while the yield strength of AZ91D with a T4 temper is reduced in comparison to 380 HPDC, the above data does indicate that squeeze cast AZ91D with a T4 temper may be a good substitute for HPDC made using magnesium alloys (i.e., AM60 or AM50) that would typically suffer from overall mechanical integrity such as, for example: skin effect; porosity; and the like.

It must also be noted that tensile properties listed in the literature for alloys, and particularly for AZ91D, cannot be compared to the test data reported herein. The tensile properties listed in the literature are measured under vastly different conditions. The published tensile data are based on separately cast tensile specimens with a different shape and solidification rate, among other differences, while the data reported herein are based on actual machined components. As will be readily apparent to one skilled in the art, published tensile data based on separately cast tensile specimens are predictive of the tensile properties of machined components. AZ91D machined by squeeze casting shows unexpectedly improved tensile properties over AZ91D machined by other casting techniques, such as HPDC.

Figure 6:
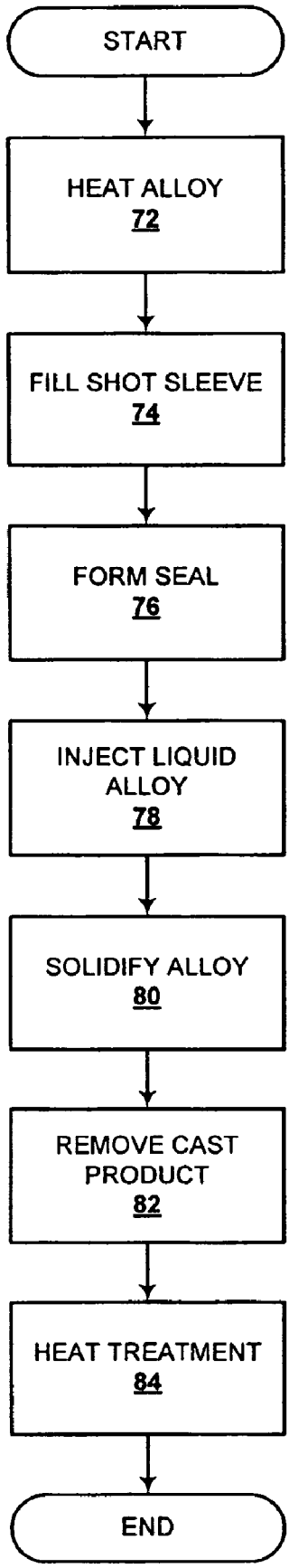
FIG. 6 is a flow diagram of a method suitable for generating a cast product according to an embodiment of the invention.

FIG. 6 is a flow diagram of a method 70 suitable for generating a cast product according to an embodiment of the invention. Prior to initiation of the method 70, a variety of steps may be performed in preparation for performing the method 70. These step may include, in no particular order, some or all of the following: a cast product is designed; a die, based upon the product is designed and constructed; the die is fitted to the squeeze casting apparatus 10; a supply of AZ91D alloy is obtained and/or components of the AZ91D alloy are obtained; the squeeze casting apparatus is powered and various heating elements are allowed to obtain working temperature; and the like.

At step 72 the method 70 is initiated by heating the AZ91D alloy to a temperature sufficient to liquefy the metal. In general, the liquidus temperature of AZ91D is about 1105° F. or 595° C. Typically, the alloy is heated somewhat beyond this temperature to allow for contact with relatively cooler surfaces without solidification of the alloy. Therefore, the casting temperature is about 1160° F. (625° C.) to about 1290° F. (700° C.).

At step 74 the shot sleeve 44 is filled. For example, the injection unit 32 is tilted to accept liquid alloy from the transfer vessel 42 or other such transfer device or conduit. In addition, prior to filling, the shot sleeve 44 may be prepared to receive the liquid alloy. For example, pneumatic ram 38 within the shot sleeve 44 may be withdrawn and/or the temperature of the shot sleeve 44 may be modulated.

At step 76 a seal is formed between the shot sleeve 44 and the die 28. For example, the die 28 is clamped upon the shot sleeve 44 via the action of the die clamp 12. In another example, the shot sleeve 44 is inserted into a recess of the die 28 to form an essentially liquid tight seal between the shot sleeve 44 and the die 28.

At step 78 the liquid alloy is injected into the die cavity 30. According to an embodiment of the invention, the liquid alloy is injected into the die cavity 30 by the injection unit 32 at a pressure of greater than about 69 Mega Pascal (Mpa) and a gate velocity of less than about 500 millimeters per second (mm/sec). The relatively slow gate velocity facilitates generation of a minimum of turbulence which tends to reduce the porosity of the cast product. The pressure also tends to reduce the porosity of the cast product by compressing any entrapped gas. In addition, the pressure facilitates movement of the liquid alloy into recesses present in the die cavity 30.

At step 80 the liquid alloy is solidified within the die cavity 30. For example, heat is conveyed through the die 28 and into the surrounding environment. In addition, a cooling system may be configured to reduce the temperature of the die 28. In this manner, the liquid alloy is solidified and the cast product 40 generated.

At step 82 the cast product 40 is removed from the die cavity 32. For example, the actuator 22 is controlled to separate the die 30 and the cast product is withdrawn and/or pushed out of the die 30. At this point the cast product 40 typically also includes some amount of undesired material such as sprue. This undesired material is removed and/or the cast product 40 is machined as indicated.

At step 84 the cast product 40 is, optionally, heat treated. For example, a T4 or T6 temper is applied to the cast product 40. The heat treatment generally increases the strength and/or otherwise improves material characteristics of the cast product. Following the step 82 or 84 the squeeze casting apparatus 10 may idle until instructed to generate another cast product 40.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method for making a cast product by squeeze casting using an AZ91D alloy, the method comprising:

heating the AZ91D alloy to a liquid state;

filling a shot sleeve with the liquid AZ91D) alloy;

forming a seal between the shot sleeve and a die;

injecting the liquid alloy into the die with an injection unit at a pressure of greater than about 69 Mega Pascal (Mpa) and a gate velocity of less than about 500 millimeters per second (mm/sec); and solidifying the AZ91D alloy in the die to generate the cast product.

2. The method according to claim 1, further comprising: removing the cast product from the die.

3. The method according to claim 1, wherein forming a seal further comprises:

clamping the shot sleeve in the die with a clamp.

4. The method according to claim 1, wherein the pressure is between 70 Mpa and 100 Mpa.

5. The method according to claim 1, wherein the gate velocity is between 100 mm/sec and 500 mm/sec.

6. The method according to claim 5, wherein the gate velocity is between 300 mm/sec and 500 mm/sec.

7. The method according to claim 1, further comprising: applying a heat treatment to the cast product.

8. The method according to claim 7, wherein the heat treatment is a T4 temper.

9. The method according to claim 7, wherein the heat treatment is a T6 temper.

* * * * *

UNITED STATES PATENT AND TRADEMARK OFFICE

CERTIFICATE OF CORRECTION

PATENT NO. : 7,165,598 B2
APPLICATION NO. : 10/950491
DATED : January 23, 2007
INVENTOR(S) : Rathindra DasGupta It is certified that error appears in the above-identified patent and that said Letters Patent is hereby corrected as shown below:

Column 8
Line 32, please replace "AZ91D)" with --AZ91D--.

Signed and Sealed this

Tenth Day of April, 2007

JON W. DUDAS
*Director of the United States Patent and Trademark Office*